US007428767B2

(12) United States Patent
Lougheed

(10) Patent No.: US 7,428,767 B2
(45) Date of Patent: Sep. 30, 2008

(54) SWEEPER INCLUDING FLOATING BRUSH OR DRUM ASSEMBLY

(75) Inventor: Christopher W. Lougheed, Cold Springs, MN (US)

(73) Assignee: Clark Equipment Company, Montvale, NJ (US)

( * ) Notice: Subject to any disclaimer, the term of this patent is extended or adjusted under 35 U.S.C. 154(b) by 190 days.

(21) Appl. No.: 11/263,479

(22) Filed: Oct. 31, 2005

(65) Prior Publication Data

US 2007/0094819 A1 May 3, 2007

(51) Int. Cl.
*E01H 1/04* (2006.01)

(52) U.S. Cl. ..... 15/82; 15/340.3; 15/383

(58) Field of Classification Search ..... None
See application file for complete search history.

(56) References Cited

U.S. PATENT DOCUMENTS

| | | | | |
|---|---|---|---|---|
| 2,697,846 | A | 12/1954 | Wilcox et al. | 15/83 |
| 2,708,280 | A | 5/1955 | Antos et al. | 15/83 |
| 4,895,476 | A | 1/1990 | Vangaever | 404/6 |
| 5,060,732 | A | 10/1991 | Baskett | 171/63 |
| 5,369,832 | A | 12/1994 | Hagger | 15/83 |
| 5,373,652 | A | 12/1994 | Olsson | |
| 6,269,560 | B1 | 8/2001 | Pratt | |
| 6,687,939 | B1 | 2/2004 | Koester | 15/83 |
| 2003/0182748 | A1 | 10/2003 | Watts | 15/83 |

FOREIGN PATENT DOCUMENTS

| | | |
|---|---|---|
| GB | 2210651 A | 6/1989 |

*Primary Examiner*—David A Redding
(74) *Attorney, Agent, or Firm*—Westman, Champlin & Kelly, P.A.

(57) ABSTRACT

A sweeper including a rotating brush or drum supported by a float arm movably coupled to a bucket. The float arm is coupled to a linkage to movably support the float arm between a retracted position and a forward position. Float arm is supported independently of a hood connected to the bucket and is movable through linkage relative to hood. In an illustrated embodiment, float arm is rotationally coupled to linkage to compensate for height variations and/or provide a mechanism to rotate linkage to move the float arm forward relative to the bucket.

18 Claims, 10 Drawing Sheets

SWEEPER INCLUDING FLOATING BRUSH OR DRUM ASSEMBLY

BACKGROUND OF THE INVENTION

Sweepers include a rotating brush or broom to sweep debris or material into a bucket. Sweepers are attached to a power machine or vehicle to move along the ground or surface to sweep material and debris into the bucket. The brush is rotated by a motor which is operated from a cab or through controls of the power machine or vehicle. The brush or broom of the sweeper is enclosed within a hood to contain dust and debris.

Material and debris collected in the bucket of the sweeper needs to be periodically emptied. Typically the brush is located in close proximity to the bucket for sweeping. The close position of the brush, however, can make it difficult to empty the bucket of debris. The present invention provides solutions to these and other problems.

SUMMARY OF THE INVENTION

The present invention relates to a sweeper including a rotating brush or drum which sweeps material or debris into a bucket. The rotating brush or drum is supported by a float arm movably coupled to a bucket. The float arm is coupled to a linkage to movably support the float arm between a retracted position and a forward position. Float arm is supported independently of a hood connected to the bucket and is movable through the linkage relative to the hood.

In an illustrated embodiment, float arm is rotationally coupled to the linkage to compensate for height variations and/or provide a mechanism to rotate the linkage to move the float arm forward relative to the bucket.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION OF ILLUSTRATIVE EMBODIMENTS

Figure 1:
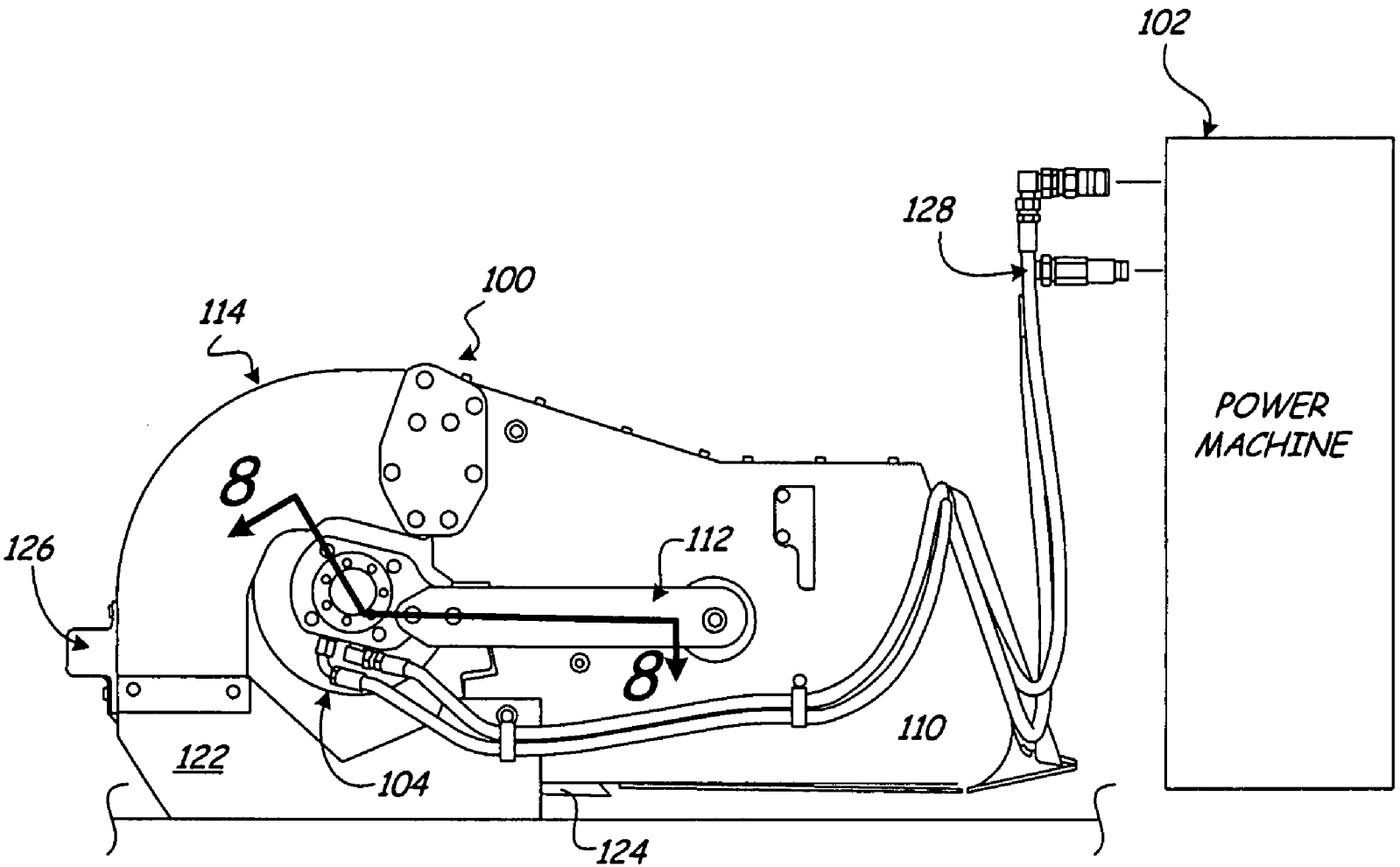
FIG. 1 illustrates an embodiment of a sweeper for a power machine illustrated schematically.

FIG. 1 illustrates one embodiment of a sweeper 100 for a power machine 102 (illustrated schematically in FIG. 1) to sweep debris or material. The sweeper 100 includes a sweeper brush or broom 104 which is rotated to sweep debris and material into a bucket 110. The brush or drum 104 is supported by a float arm 112 forward of the bucket 110 and a sweeper hood 114 is coupled to the bucket 110 to enclose the brush or broom 104.

Sweeper is connected to a power machine 102 for use. For example, the sweeper can be removably coupled to the power machine 102 for intermittent use or fixed to the power machine for continuous use. A flexible guard flap 122 is coupled between the hood 114 and leading edge of the bucket 110 to contain dust or debris. Example materials for the guard flap 122 include rubber. In the embodiment shown, the hood 114 of the sweeper includes a support bracket 126 to mount a gutter brush or other implement (not shown in FIG. 1) to the leading edge of the sweeper. Hydraulic or transmission lines 128 are coupled to the sweeper to provide power to rotate the sweeper brush 104 through the power machine 102.

Figure 2:
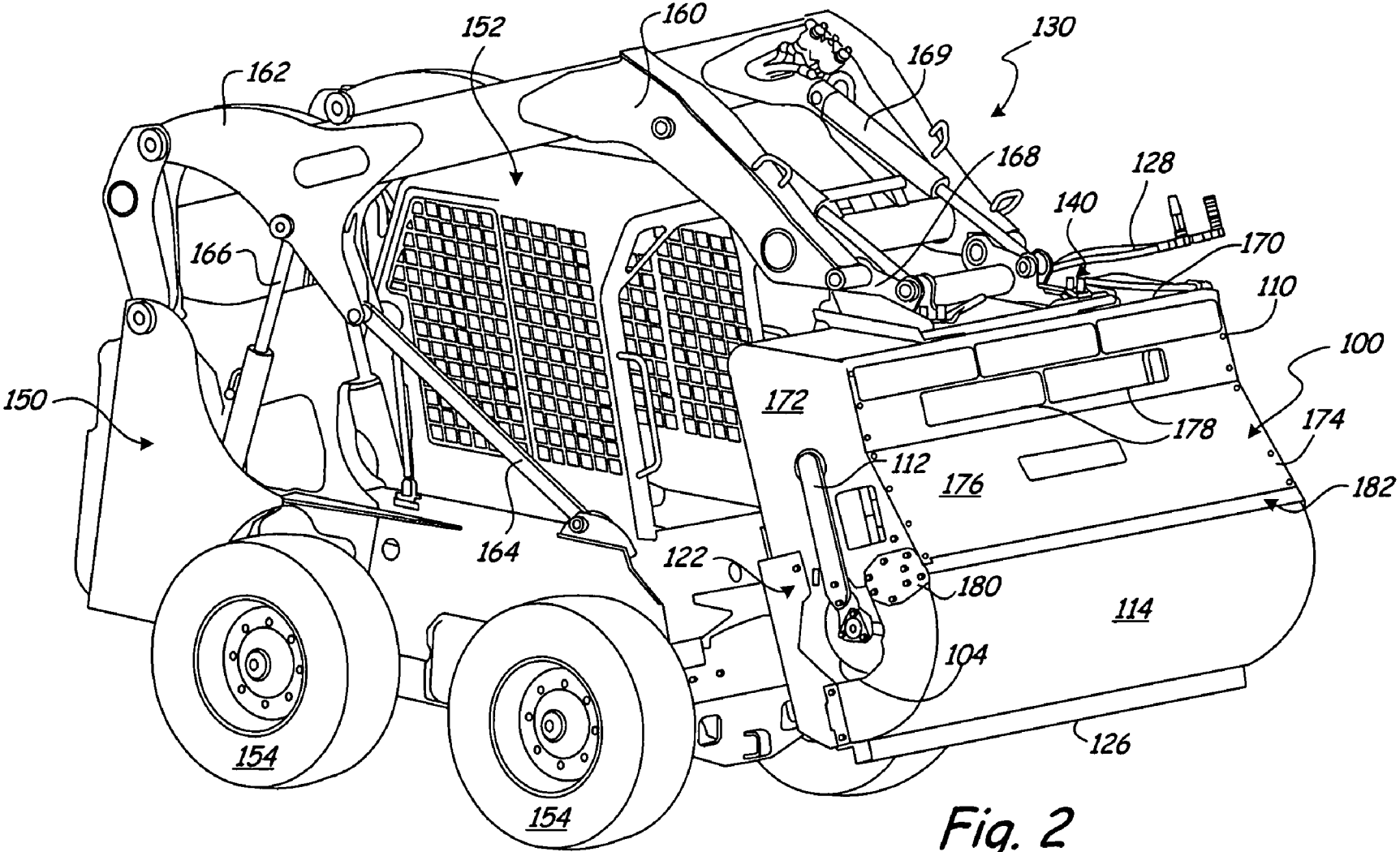
FIG. 2 illustrates a sweeper attached to a power machine or vehicle in a raised dump position.

FIG. 2 illustrates sweeper 100 coupled to a utility vehicle 130 through a power machine attachment 140. One embodiment of a utility vehicle 130 to which the sweeper 100 is attached includes a vehicle body or frame 150 and operator cab 152. Wheels 154 are coupled to the frame 150 so that the vehicle 130 can move over the ground during use. Application, however, of the present invention is not limited to a wheeled vehicle or loader as shown. For example, the present invention has application for a power machine which moves along a track instead of wheels.

Sweeper 100 connected to utility vehicle 130 is raised and lowered via lift arms 160 coupled to the body 150 of the machine via linkage 162 and tie rod 164. Fluid cylinders or actuators 166 (only one shown in FIG. 3) are coupled to the body 150 and lift arms 160 to provide vertical lift to the sweeper 100. Sweeper 100 is rotated relative to the lift arms 160 through tilt linkage 168 and tilt cylinder(s) 169 to adjust an orientation of the sweeper between a sweeping orientation shown in FIG. 1 and a dumping orientation shown in FIG. 2.

In the sweeping orientation, the lift arms 160 are lowered and the tilt linkage 168 is orientated so that the sweeper 100 moves along the ground. The sweeper 100 is positioned in the dumping orientation by raising the lift arms 160 as shown and tilting the bucket 110 of the sweeper downward so that a bottom surface of the bucket 110 is orientated generally vertical to the ground.

The bucket 110 of the sweeper includes a back portion 170, side plates 172, 174 (side plate 174 not visible in FIG. 2) and cover 176. Sweeper is attached to vehicle 130 through machine attachment 140 along the back portion 170 of the bucket 110. Cover 176 is attached to side plates 172, 174 of the bucket. In the embodiment shown, the cover 176 includes a plurality of skid resistant plates 178 to allow a user to climb on top of the sweeper to access the cab 152. Hood 114 is coupled to bucket 110 via mounting plate 180 and a flexible flap 182 is disposed between cover 176 and hood 114 to contain dust and debris.

Figure 3:
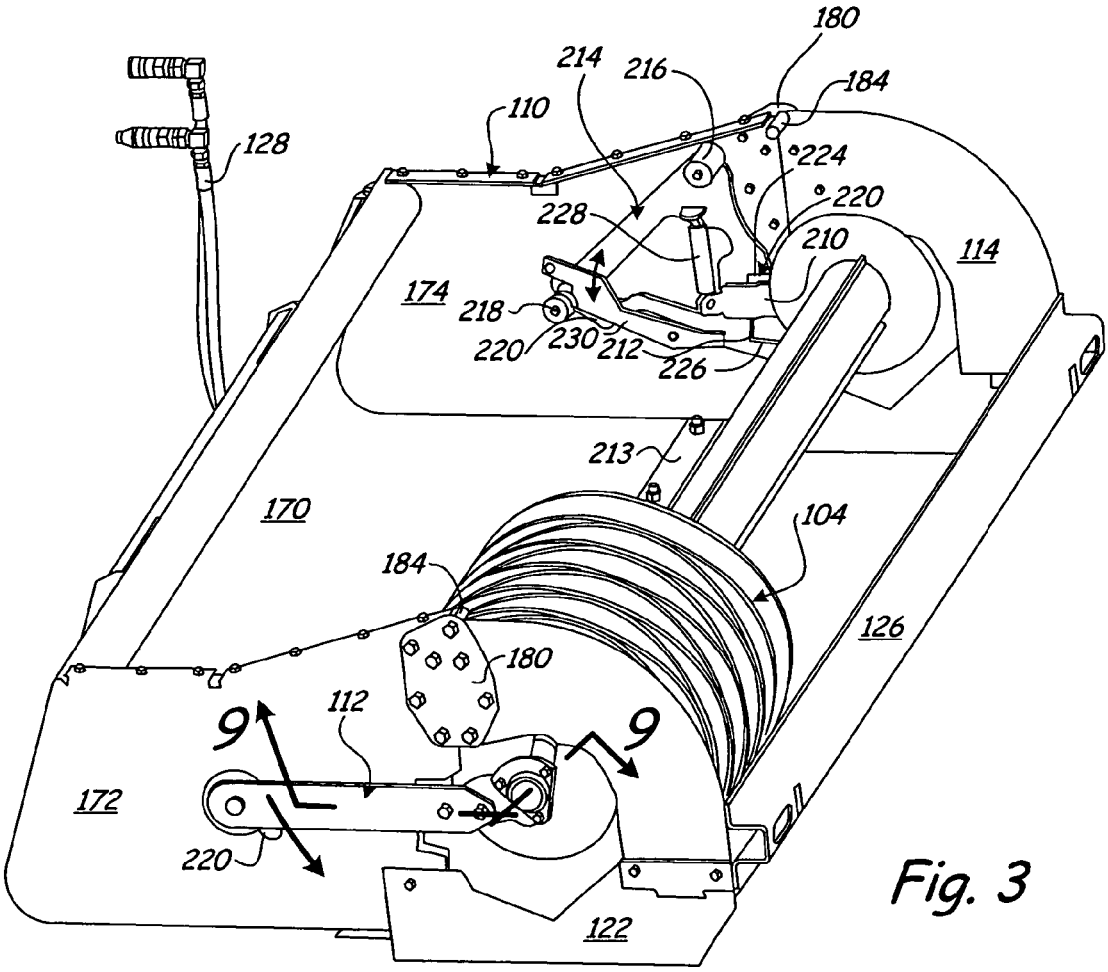
FIG. 3 is a perspective illustration of the sweeper of FIG. 1 with the cover and portion of the hood removed for illustration.

FIG. 3 illustrates the sweeper of FIGS. 1-2 with the cover 176 removed to illustrate inner components. As shown in FIG. 3, the bucket 110 includes pivot pin 184. Hood 114 rotates about pivot pin 180 to open hood 114 for access to an inside of the sweeper. To pivot or open the hood 114, the bolts holding the hood 114 to the mounting plate 180 are removed. The hood 114 rotates closed and the bolts are replaced to secure the hood 112 to the mounting plate 180.

As previously described, brush 104 is supported by float arm (or float arms) 112. The float arms 112 are movably supported relative to the bucket 110 to floatably support the brush or broom 104 relative to the bucket. The float arm or arms 112 support the brush or drum 104 independent of the bucket 110 and hood 112 which reduces the moving mass of the floating system. This increases the life of the brush and improves sweeping results. The height of the float arm or arms 112 is designed to support brush or broom 104 so that ends of bristles of the broom or brush 104 are slightly bent to flick dust and debris into the bucket upon rotation of the brush 104. A height of float arm 114 can be adjusted to adjust for wear.

Movement of the float arms 112 relative to the bucket 110 is controlled through an interface between stop block 210 and back stop 212. In the illustrated embodiment, the stop block 210 is coupled to the float arm 112 (not visible in FIG. 3) and back stop 212 is coupled to bucket 110. During operation back stop 212 interfaces with stop block 210 to maintain a spaced distance between the brush or broom and blade 213 proximate to the leading edge of the bucket 110. For operation the drum or brush 104 can rotate either clockwise or counterclockwise. In the clockwise direction, the brush imparts a back force or rotation to the float arm 112. The back stop 212 interfaces with stop block 210 to counteract the back force or rotation to maintain separation between the brush or drum 1-4 and the bucket 110. Float arm 112 and back stop 212 as described reduces differences in sweep patterns between different rotation directions.

In one embodiment, back stop 212 is formed on linkage 214 which is rotationally coupled to the bucket 110 at pivot 216. Float arm or arms 112 are rotationally connected to linkage 214 at a position spaced from pivot 216 of linkage 214. As shown, float arm 112 and linkage 214 are coupled via a bearing 218 which extends through slot 220 on side plates 172 and/or 174 of the bucket 110. In one embodiment, bearings 218 can be GAR-MAX® or GAR-FIL$^{TM}$ brand bearings sold by Glacier Garlock. The GAR-MAX® or GAR-FIL$^{TM}$ brand bearings have a lubricious layer and are grease free so that they are better suited for the dusty environment of the sweeper.

In the embodiment described, rotation of linkage 214 about pivot 216 moves float arm 112 forward or away from the bucket through bearing 218. Bearing 218 move along slot 220 to rotate linkage 214 to move the float arm 112 forward. Linkage 214 includes slot 222 which forms the back stop 212 and opposed limit stops 224, 226. Stop block 210 is floatable in slot 222 between limit stops 224, 226 via the rotational connection of float arm 112 to linkage 214. Spring 228 is connected to linkage 214 and stop block 210 to bias the float arm 112 in a datum position so that the tips of the bristles are slightly bent for operation. Spring 228 allows the float arm to move (via rotation relative to bearing 218) to adjust the height of the brush or drum to compensate for variations in the work surface. Rotation of float arm 112 is restricted by limit stops 224, 226.

To dump debris from bucket, linkage 214 rotates forward to move bearing 218 along slot 220 to shift the float arm 112 forward away from the bucket or blade 213. As shown, rotation of linkage 214 adjusts the position of the back stop 212 of the linkage 214 forward. In the embodiment shown, rotation of the linkage 214 is controlled through operation of a gravitationally actuated latch mechanism. The gravitational latch mechanism includes a latch which is released by a latch release on the float arm 112. The latch release operates in response to rotation of the float arm 112 as a result of a gravitational force imparted to the float arm 112 based upon a shift in a center of gravity of the brush or broom when the sweeper is raised and/or orientated to dump debris.

In the embodiment shown, the latch includes latch arm 230 which abuts a contact (which in the illustrated embodiment is bearing 218) on the linkage 214 to restrict rotation of linkage about pivot 216. The latch arm 230 normally restrict rotation of the linkage 214 while the sweeper is supported relative to the ground. The latch arm 230 rotates to release to release linkage 214 via interface with the latch release on the float arm 112 in response to the shift in the center of gravity of the brush or drum 104.

Figure 4:
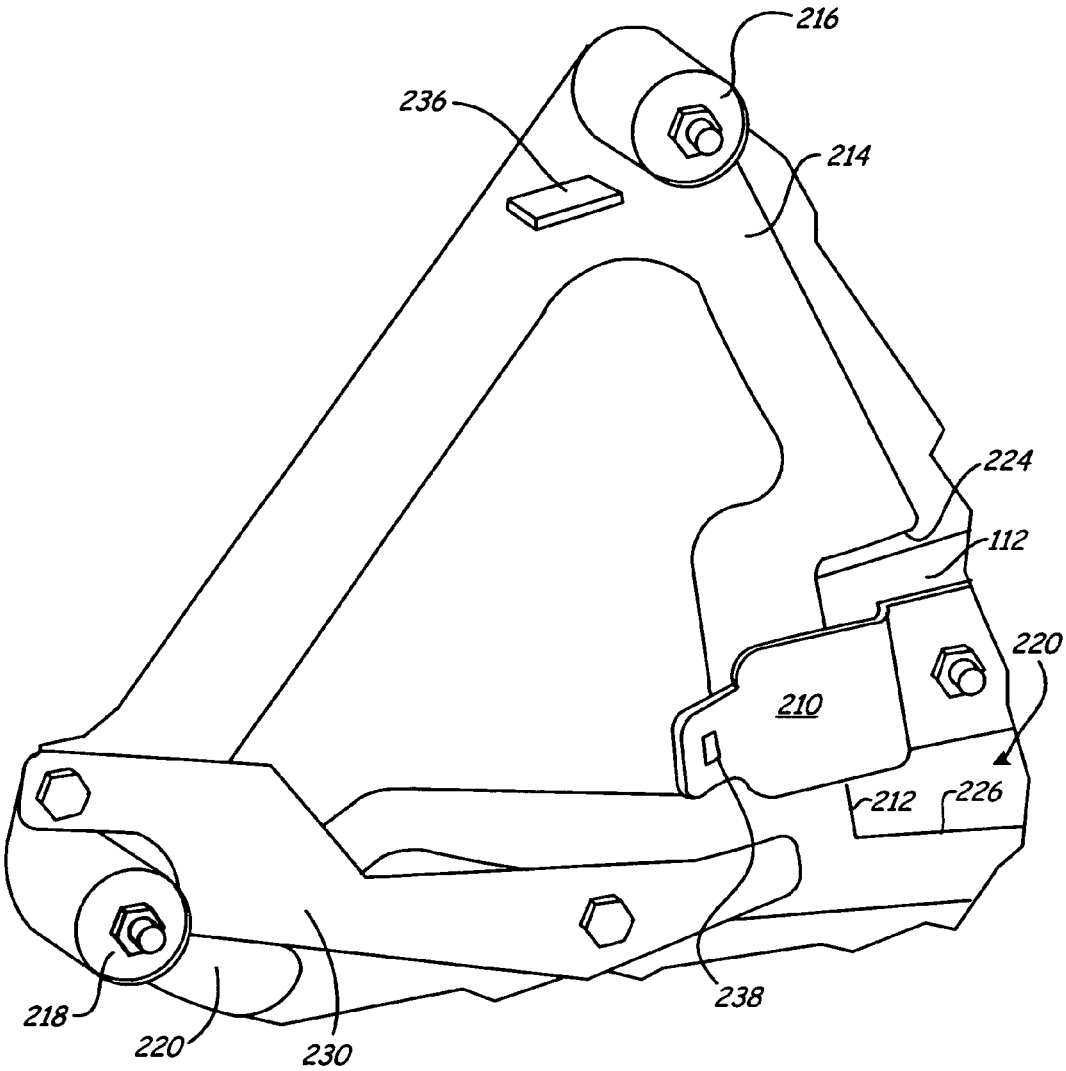
FIGS. 4-5 illustrate a linkage to adjust a position of the brush or drum of the sweeper.
Figure 5:
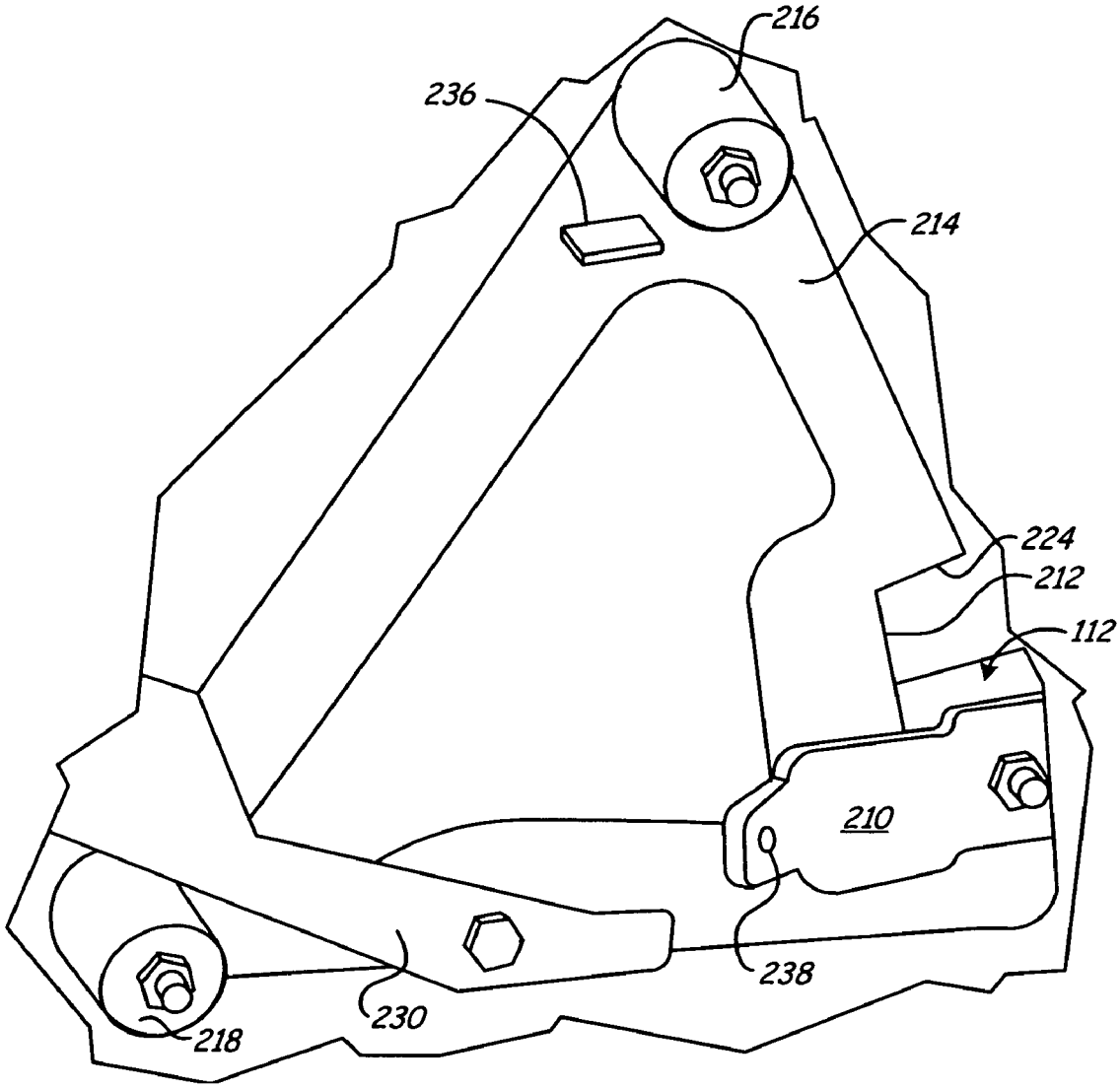
Figure 6:
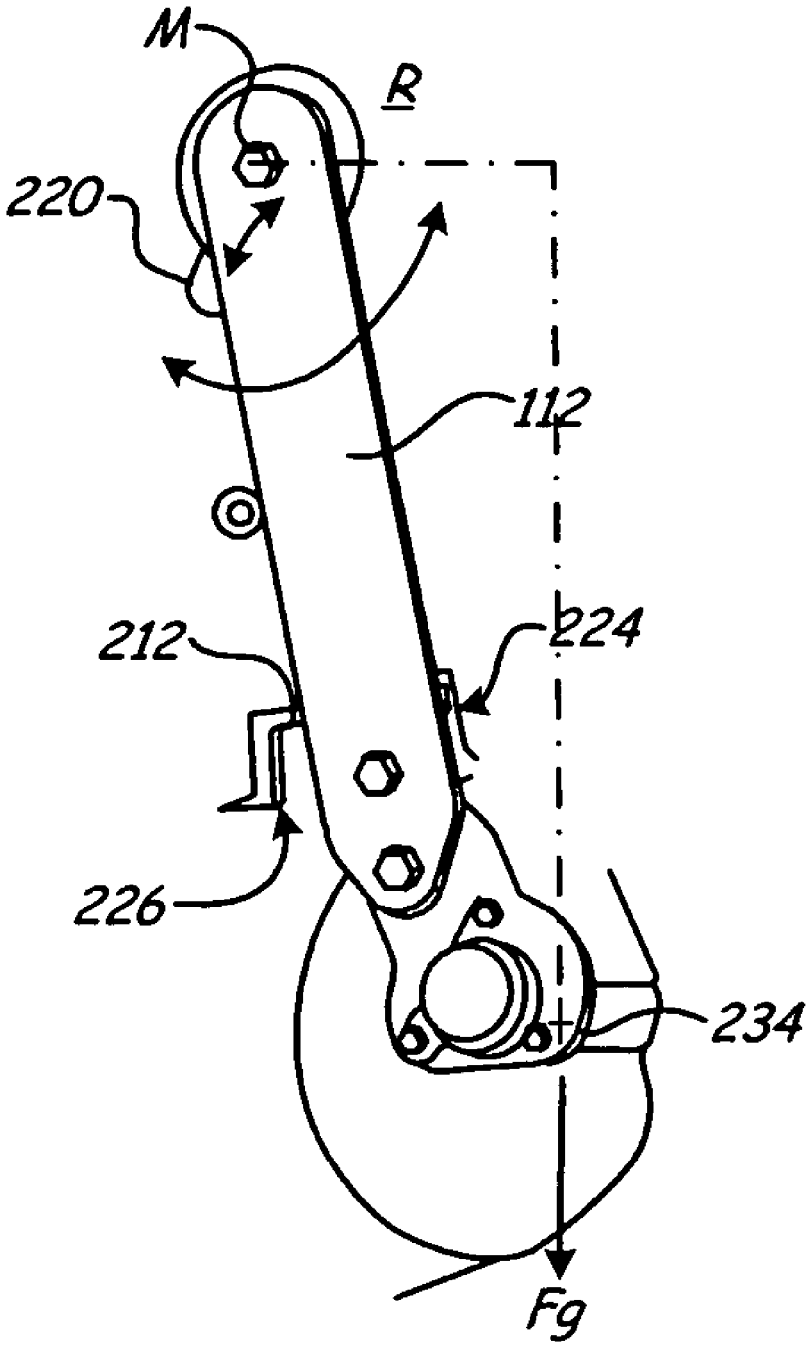
FIG. 6 illustrates rotation of the float arm relative to a center of gravity.

As shown in FIG. 4 (spring not shown), latch release is formed on stop block 210 of float arm 112. The latch release is aligned to contact latch arm 230 to rotate latch arm 230 away from bearing 218 as shown in FIG. 5. Latch release contacts the latch arm 230 when the stop block 210 is proximate to stop limit 226. Stop block 210 moves towards the stop limit 226 as the sweeper is raised due to a shift of the center of gravity of drum or brush, since the brush is no longer supported on the ground. As shown in FIG. 6, when the brush is no longer supported on the ground, the center of gravity 234 of the brush or broom shifts to provide a rotation force or moment to rotate the float arm 112 against the spring bias towards limit stop 226.

As shown, in FIG. 5, when the stop block 210 is proximate to limit stop 226, the latch release contacts latch arm 230 to release linkage 214. Linkage 214 rotates about pivot 216 under the influence of gravity to shift the position of the float arm 112 forward to move the brush or drum 104 away from the bucket 110. Movement of the linkage 214 biases (through bearing 218) the latch arm 230 in an unlatched position. Since the brush or drum is supported by the float arm 112, independent of the hood 114, the additional mass of the hood does not needed to be shifted forward.

In the illustrated embodiment of FIGS. 4-5, linkage 214 is triangular shaped. Spring 228 shown in FIG. 3 connects to linkage 214 through spring attachment 236 and to float arm 112 through attachment 238 on stop block 210. Once the sweeper is lowered and the brush or broom is supported relative to the ground as shown in FIG. 1, the linkage 214 is retracted and latched to restrict rotation of the linkage 214.

In the illustrated embodiment, the linkage 214 rotates clockwise under influence of gravitational force imparted to the cantilevered float arm 112 when the sweeper 100 is again supported along the ground as illustrated in FIG. 1. The force transfers through bearing connection 218 to rotate the linkage 214 clockwise to retract the linkage 214 and float arm 112 from the forward or extended position. As the linkage 214 retracts, bearing connection 218 moves to allow latch arm 230 to rotate to the latched position to again restrict rotation of the linkage. In the embodiment shown, the latch arm 230 includes transverse latch surfaces to restrict rotation of the linkage in both the forward (counterclockwise) and clockwise directions.

Figure 7:
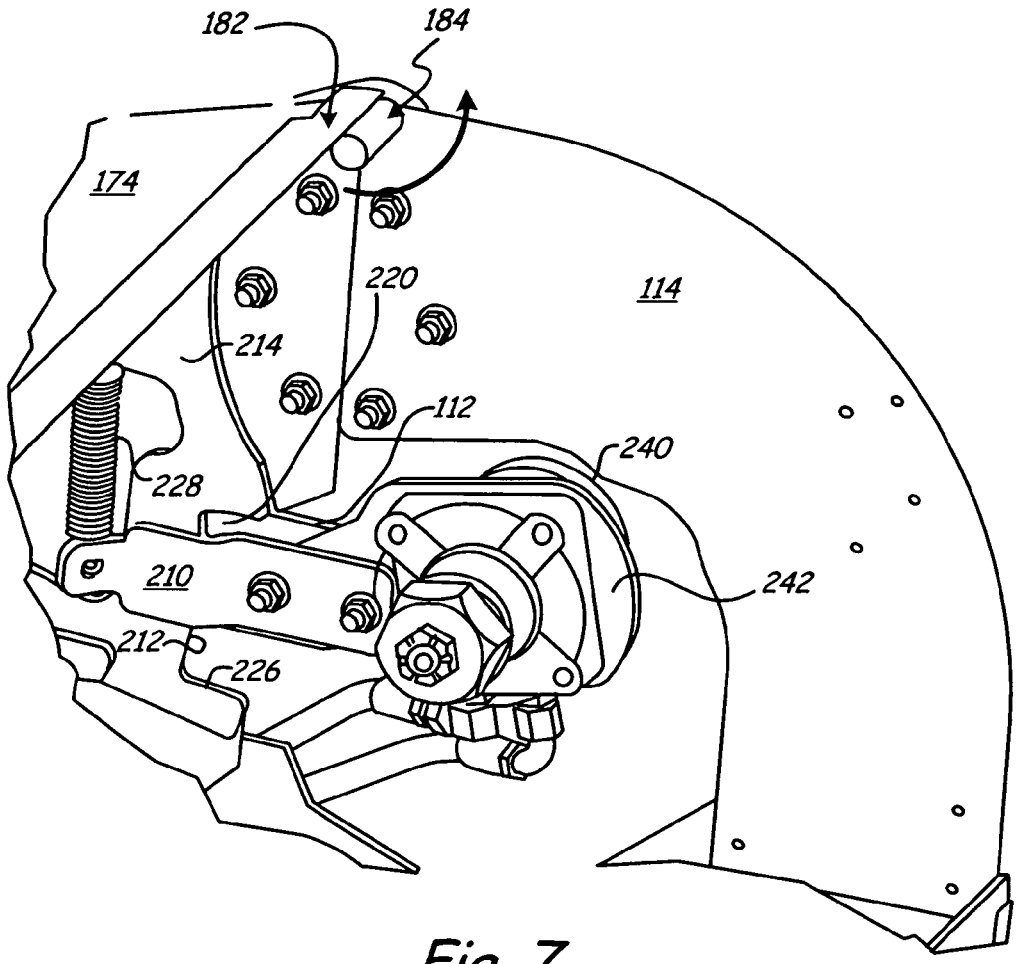
FIG. 7 is a detailed illustration of a portion of a float arm of the sweeper.
Figure 8:
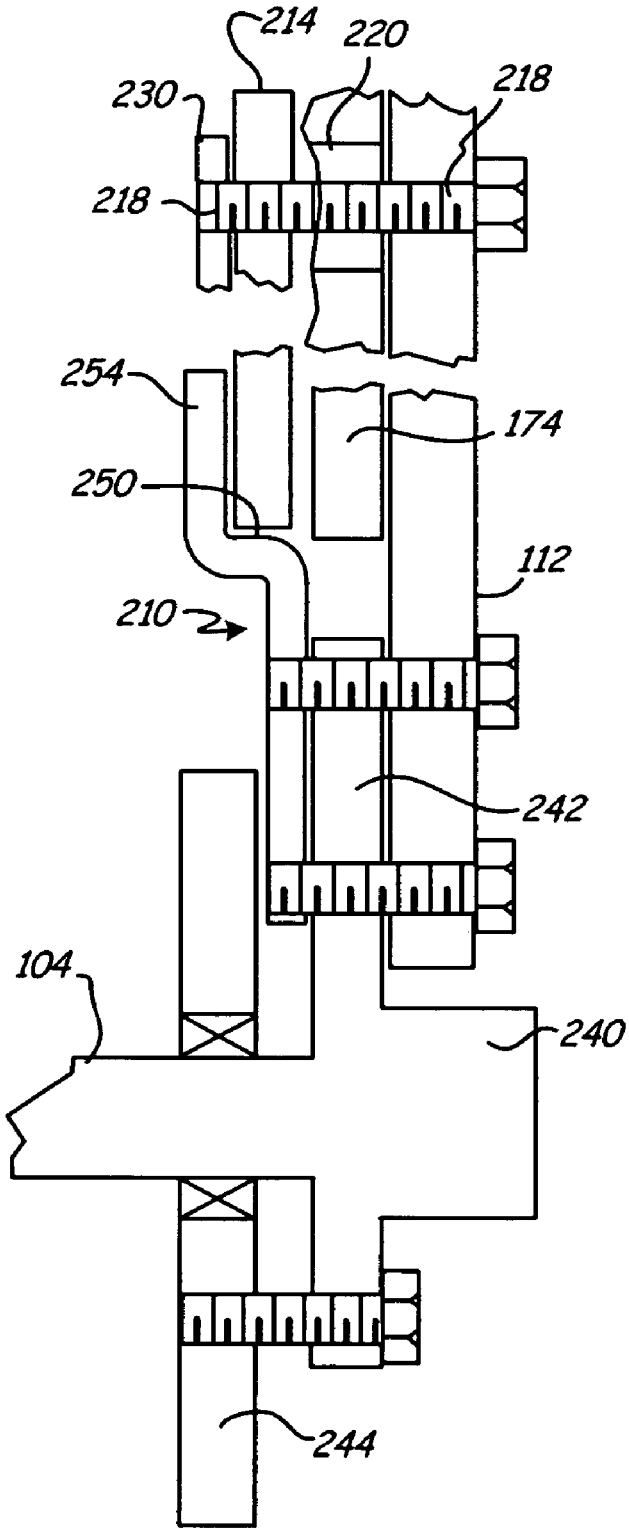
FIG. 8 is a cross-sectional view taken along line 8-8 of FIG. 1.

In the embodiment shown in FIG. 7, the linkage 214 includes a contoured portion to provide clearance for mounting plate 180 for hood 112. FIG. 7 illustrates a linkage 214 and float arm 112 assembly for side plate 174 which includes motor 240 to rotate brush. As shown, motor 240 is coupled to float arm through motor flange 242. The flange 242 connection can be adjusted to adjust the height of the float arm 112 and brush or drum 104 relative to the bucket. Stop block 210 and motor flange 242 are bolted to the arm 112 as shown in FIG. 8. A drum or the brush 104 is rotationally coupled to float arm 112 through flange 244, which is coupled to or bolted to the motor flange 242 as illustrated in FIG. 8.

As shown in FIG. 8, the stop block 210 is formed of an elongate curved shaped member mounted to the float arm 112. The elongate member includes a first portion which moves within slot 220 of linkage 214 and includes opposed surfaces designed to abut limit stops 224, 226 and an end surface 250 aligned to contact back stop 212 to limit movement of the float arm 112. The elongate member includes a raised portion 254 which forms the latch release. The raised portion 254 moves over linkage 214 and is aligned to contact latch arm 230 when the first elongate portion is proximate to stop limit 226 as previously discussed. As shown, linkage 214 and bucket wall 174 are sandwiched between the arm 112 and stop block 210 to limit lateral movement of the float arm 112 relative to the bucket.

Figure 9:
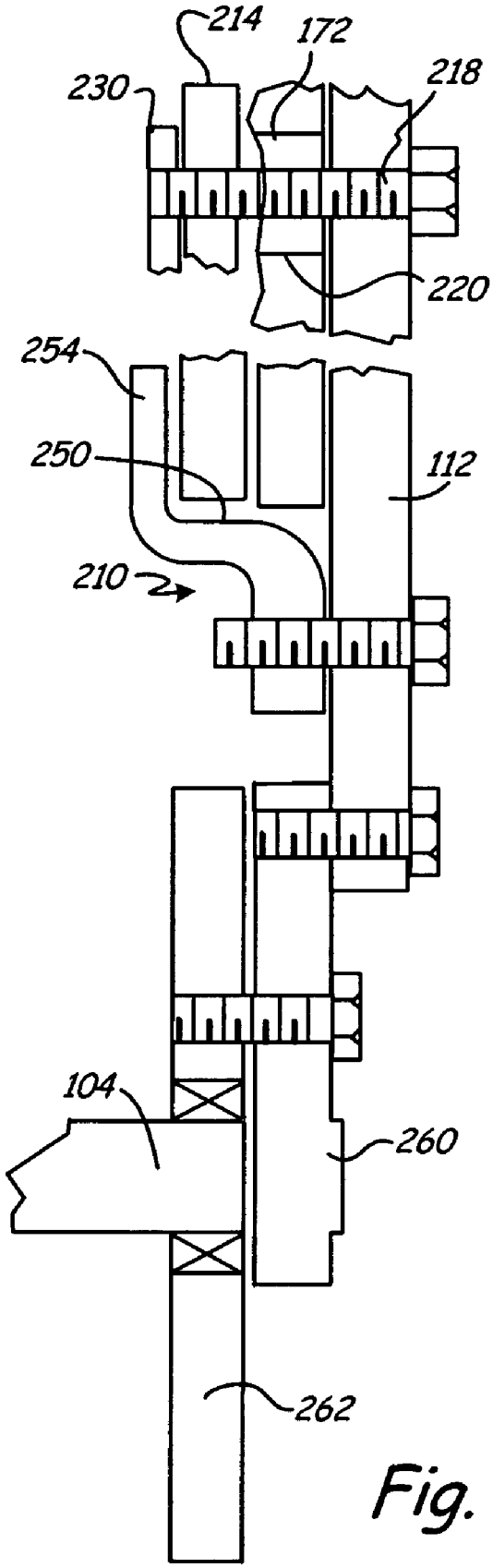
FIG. 9 is a cross-sectional view taken along line 9-9 of FIG. 3.
Figure 10:
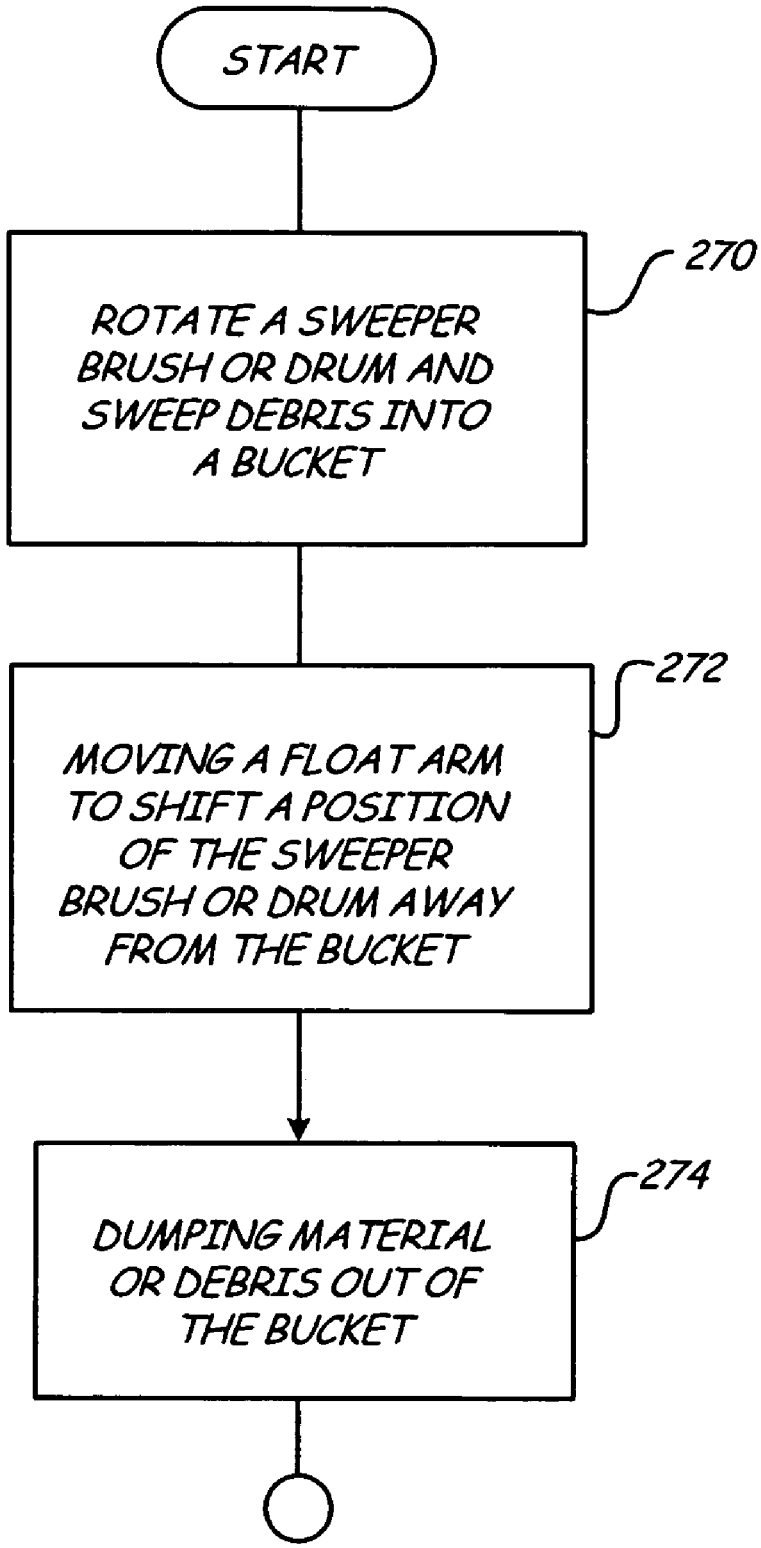
FIG. 10 is a flow chart illustrating sweeping steps.

In one embodiment a float arm 112 is coupled to both side plate 172 and 174 of bucket. FIG. 9 illustrates float arm 112 coupled to side plate 172 to through float link 260 and flange 262 to support the brush or drum 104. The sweeper brush is attached to a power machine or vehicle for use. As illustrated by step 270 of FIG. 10, the sweeper brush or drum 104 rotates and debris is swept into a bucket 110. The sweeper brush as described is supported by a float arm 112 separate from the bucket and hood 114 coupled to the bucket 110. As illustrated in step 272 of FIG. 10, the float arm 112 moves to shift a position of the sweeper brush or drum away from the bucket 110 to dump material or debris out of the bucket as illustrated by step 274. In embodiments described, the float arm 112 automatically shifts the position of the sweeper brush or drum as the sweeper is raised and/or tilted based upon gravitational forces as described.

In one embodiment, a center of gravity of the brush or drum creates a moment which rotates float arm 112. Rotation of the float arm 112 releases a latch assembly to rotate linkage 214 which moves the float arm 112 via connection of the float arm 112 to the linkage 214. Connection of the float arm 112 to linkage 214 can be adjusted (i.e. up or down) to adjust the height of the brush or drum 104. Since the float arm 112 supports the brush or drum separate from the hood 114, the brush or drum moves relative to the hood to provide a small mass which is moved to provide dumping clearance.

Following dumping, the linkage 214 rotates clockwise to retract the float arm 112 from the forward position. The linkage 214 is rotated clockwise in response to a shift of a center of gravity of the float arm 112 coupled to the linkage 214. In particular, the center of gravity of the cantilevered arm 112 is spaced from pivot 216 which imparts a rotational force or moment relative to pivot 216. The gravitational force rotates linkage 214 clockwise about pivot 216 to bias linkage towards bucket 110 to retract the float arm 112.

Although the present invention has been described with reference to preferred embodiments, workers skilled in the art will recognize that changes may be made in form and detail without departing from the spirit and scope of the invention.

What is claimed is:

1. A sweeper comprising:

a bucket;

a float arm movably coupled to the bucket;

a sweeper brush or drum rotationally coupled to the float arm;

a hood coupled to the bucket to enclose the sweeper brush or drum and the sweeper brush or drum movably supported relative to the hood by the float arm; and a stop block on the float arm which is configured to interface with a back stop coupled to the bucket.

2. The sweeper of claim 1 and comprising: a motor coupled to the float arm to rotate the sweeper brush or drum.

3. The sweeper assembly of claim 1 and comprising: a linkage mechanism coupled to the float arm and configured to move the float arm relative to the bucket in response to gravitational force imparted relative to a center of gravity of the sweeper brush or drum.

4. The sweeper of claim 1 and comprising a linkage coupled to the bucket and rotatable about a pivot and the float arm is coupled to the linkage via a float arm connection spaced from the pivot to move the float arm relative to the bucket.

5. The sweeper of claim 4 and further including a latch adapted to interface with the linkage to restrict rotation of the linkage and upon release of the latch the linkage rotates about the pivot to move the float arm relative to the bucket.

6. The sweeper of claim 4 wherein the float arm is rotationally coupled to the linkage and the float arm includes a latch release to release a latch restricting rotation of the linkage via rotation of the float arm.

7. The sweeper of claim 1 and further comprising a power machine attachment to connect the sweeper to a power machine to lift or tilt the sweeper and in a lifted or tilted position, the float arm rotates under an influence of gravity to release a latch restraining movement of the float arm relative to the bucket.

8. The sweeper of claim 1 wherein the float arm is rotationally coupled to a linkage and the float arm includes a stop block which moves between stop limits.

9. A sweeper linkage comprising:

a float arm;

a sweeper brush or drum rotationally coupled to the float arm;

a linkage including a pivot and the float arm coupled to the linkage through a connection spaced from the pivot;

a latch to restrain rotation of the linkage about the pivot; and wherein the float arm is rotationally coupled to the linkage and includes a latch release adapted to release the latch via rotation of the float arm.

10. The sweeper linkage of claim 9 wherein the float arm is rotationally coupled to the linkage and includes a stop block which interfaces with a back stop on the linkage.

11. The sweeper linkage of claim 9 wherein the linkage is a triangular shaped linkage.

12. The sweeper linkage of claim 9 wherein the float arm rotates in response to a gravitational force or moment imparted to the float arm.

13. The sweeper linkage of claim 9 wherein the float arm is rotationally coupled to the linkage and includes a stop block movable between stop limits on the linkage.

14. The sweeper linkage of claim 13 wherein the float arm includes a latch release which releases the latch based upon a position of the stop block relative to the stop limits of the linkage.

15. The sweeper linkage of claim 9 wherein the float arm is rotationally coupled to the linkage and further comprising a spring between the float arm and the linkage.

16. A sweeper comprising:

a bucket;

a float arm movably coupled to the bucket;

a sweeper brush or drum rotationally coupled to the float arm;

a hood coupled to the bucket to enclose the sweeper brush or drum and the sweeper brush or drum movably supported relative to the hood by the float arm; and a linkage mechanism coupled to the float arm and configured to move the float arm relative to the bucket in response to gravitational force imparted relative to a center of gravity of the sweeper brush or drum.

17. The sweeper of claim 16 and further comprising a stop block on the float arm which is configured to interface with a back stop coupled to the bucket.

18. The sweeper of claim 16 and further comprising a power machine attachment to connect the sweeper to a power machine to lift or tilt the sweeper and in a lifted or tilted position, the float arm rotates under an influence of gravity to release a latch restraining movement of the float arm relative to the bucket.

* * * * *